US005085594A

United States Patent [19]

Kaelin

[11] Patent Number: 5,085,594

[45] Date of Patent: Feb. 4, 1992

[54] SOLDER-FREE PLUG-CABLE CONNECTION SYSTEM

[76] Inventor: Ruedi Kaelin, Breitenweg 22A, CH-5703 Seon, Switzerland

[21] Appl. No.: 720,940

[22] Filed: Jun. 25, 1991

[30] Foreign Application Priority Data

Jul. 10, 1990 [CH] Switzerland ..... 2303/90

[51] Int. Cl.[5] ..... H01R 4/24

[52] U.S. Cl. ..... 439/427

[58] Field of Search ..... 439/427–429

[56] References Cited

U.S. PATENT DOCUMENTS 3,175,176 3/1965 Henschke ..... 439/427
3,411,129 11/1968 Peters ..... 439/427
3,810,174 5/1974 Brandenburg, Jr. ..... 439/427
4,374,458 2/1983 Komada ..... 439/427

*Primary Examiner*—Joseph H. McGlynn

*Attorney, Agent, or Firm*—Frishauf, Holtz, Goodman & Woodward

[57] ABSTRACT

To connect a cable, for example having two or more parallel connectors, to a plug, typically having coaxial sleevers (2, 3), the sleeves of the plug (2, 3), each, are formed with extending prongs (9) positioned and spaced from each other to penetrate into a cut end of the cable (6) between, or into the wires (10) of the cable and the surrounding insulation (12). To hold the assembly together, and prevent spreading of the cable in the region of penetration, the cable is surrounded by a clamp (16) formed of two plastic parts (28, 29) which can be snapped together; the entire connection, then, is covered by an injection-molded jacket (7), which is so arranged that the injection molding material can penetrate through openings (27) formed in the sleeve plug elements (2, 3) to thereby locate the sleeve elements securely in position within the plug (1).

13 Claims, 3 Drawing Sheets

SOLDER-FREE PLUG-CABLE CONNECTION SYSTEM

FIELD OF THE INVENTION

The present invention relates to a connection arrangement to couple a plug to a multi-wire cable, for example to couple a plug having coaxial plug terminal elements, typically in sleeve form, to a flat cable in which the individual wire elements thereof are surrounded by an elastic flexible insulation, such as plastic, typically connected together by a connecting web.

BACKGROUND

Various types of cable-plug connection arrangements are known, and particularly such connection arrangements which convert parallel wire cables to coaxial wires. Such arrangements are used frequently in antenna connectors, for low-current applications, communication apparatus and the like.

Conventional connections frequently use a solder coupling between the plug sleeves and electrically conductive wires of the cable. Before being able to make such a solder connection, it is necessary to remove the insulation surrounding the wires for at least a sufficient portion to permit soldering, so that the exposed blank wires can then be suitably connected by soldering to the metallic plug elements. If the cables are narrow or small, the danger of possible short circuit or melting of the insulation material always pertains. Solder connections are difficult to make, particularly when the wires are close to each other. Soldered connections have an additional disadvantage, namely that the solder tends to harden the cable immediately adjacent the solder connection, for example by some solder running into the cable along the wires. If the wires are bent imediately adjacent the plug, or subjected to tension, solder connections may break, and interrupt the wires, or tiny solder elements may cause short circuits.

THE INVENTION

It is an object to provide a cable-plug connection arrangement, and a cable plug which can be easily made by mass production processes, does not require soldering, provides a long-life reliable electrical connection, and is capable of accepting bending and tension forces better than solder or other prior art connection arrangements.

Briefly, the plug includes at least two electrically conductive plug elements, typically in form of sleeves, insulated from each other, which are formed with projecting pointed fingers or prongs, capable of being pressed into the end portions of the cable, and each engaging one of the wires. Usually, the cables are formed of stranded or braided wires, especially copper wires, and the prongs may penetrate between the individual strands or braids of the wires of the cable. A clamping element, preferably formed of two clamping parts which can snap together, is then placed around the region of the cable into which the prongs have extended. Preferably, the clamping element, which tightly surrounds the cable in the region of penetration of the fingers or prongs, has an axial length which is at least as long as the depth of penetration of the fingers or prongs of the plug into the cable. The connection is then completed by injection-molding a jacket of insulating, flexible material about the end portion of the cable, around the clamping element, and covering at least part of the plug, leaving only that portion exposed which may be intended for further electrical connection.

The arrangement has the advantage that it will provide a reliable electrical and mechanical connection between the plug and the cable, without requiring soldering. Removal of insulating material from the wires of the cable, before making the connection, is not necessary. The injection-molding outer jacket ensures a tight mechanical connection between the cable and the plug, which is capable of accepting tension forces, can, at the same time, provide protection against excessive bending or kinking, while sealing the electrical connection between the fingers or prongs and the wires against external influences which might interfere with the originally tight electrical engagement between the wires and the prongs and fingers, for example due to corrosion.

DRAWINGS

DETAILED DESCRIPTION

Figure 1:
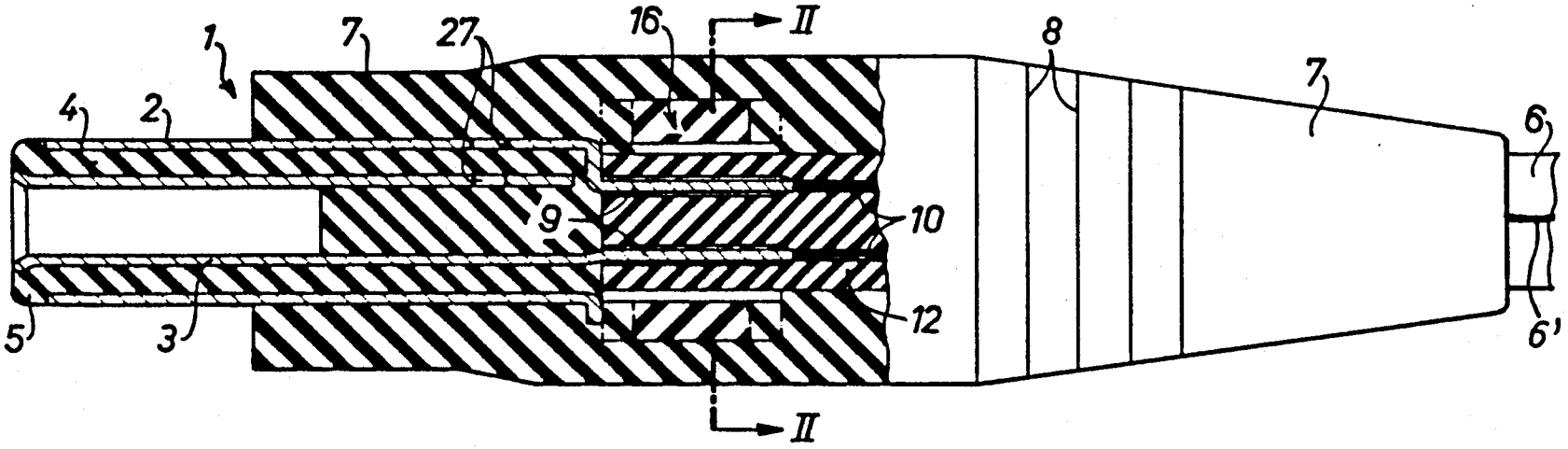
FIG. 1 is a longitudinal sectional view through the cable-plug connection.
Figure 2:
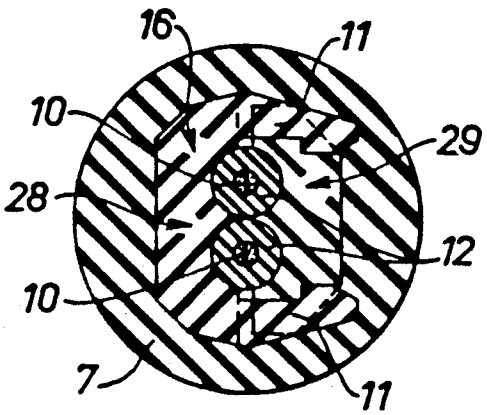
FIG. 2 is a cross section along the section line II—II of FIG. 1.
Figure 3:
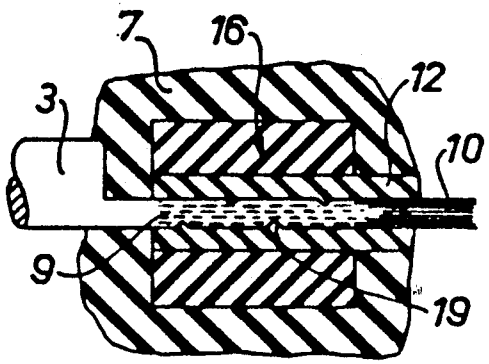
FIG. 3 is an enlarged fragmentary sectional view illustrating the solder-free electrical and mechanical connection of a plug element with one of the wires.
Figure 4:
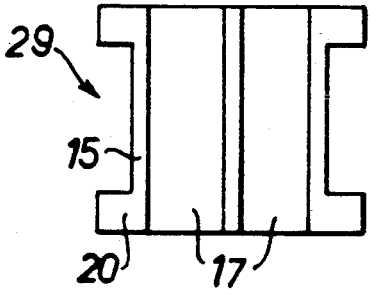
FIG. 4 is a top view of one clamping portion.
Figure 5:
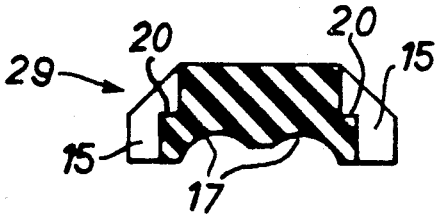
FIG. 5 is a part-sectional end view of the clamping portion of FIG. 4.

Referring first to FIGS. 1–3 and 8:

For purposes of illustration, the cable 6 will be illustrated as having two wires 10; the present invention is not restricted to a two-wire cable and a two-element plug 1; for simplicity of illustration, however, a two-wire cable 6 will be used. The plug 1 has two plug sleeves or elements 2, 3, each of which is intended for coupling to one of the wires 10 of the cable 6. A cylindrical insulating sleeve 4 separates the electrically conductive, metallic sleeves 2, 3. The insulating sleeve 4, at the end portion, terminates in an insulating ring 5. After assembly, the sleeves 2, 3 and the end portion of the cable 6, as well as the connecting elements, are all enclosed and surrounded by an injection-molded jacket 7. The jacket 7 may be suitably formed at the outer circumference with a roughened or ridged surface, for example to serve as a handling or gripping end portion for the cable 6. To increase the resistance of the end portion of the cable 6 against sharp bending or kinking, the jacket 7 is, preferably, formed with bellows-like ridges and grooves 8.

In accordance with a feature of the invention, the two metallic sleeves 2, 3 are formed with axially extending narrow pointed fingers or prongs 9, unitary with the respective sleeves 2, 3. The sleeves 2, 3, together with the unitary fingers or prongs 9, preferably, are made from a flat sheet-metal element, and rolled into cylindrical form, with the finger or prong 9 extending therefrom, that is, projecting from the respective sleeve. Other ways of making the sleeves 2, 3, together with the fingers or prongs 9, may be used; for example, they can be made as automatic screw machine parts, milled parts, drilled parts or the like. The spacing between the two prongs 9 is so selected that it corresponds, at least approximately, to the center-to-center spacing of the wires 10 within the cable 6.

The two electrically conductive wires 10 of the cable 6, as is customary, are formed as multi-conductor strands, surrounded by a flexible, electrically insulating cable cover 12. The cable cover 12, usually and typically, is an elastomer material, such as a soft plastic. The wires 10, usually, are multi-strand spiralled or twisted conductors or braided strands.

Both of the plug sleeves 2, 3 are formed with cross bores 27 (FIG. 1) to permit penetration of the plastic material of the outer jacket 7 upon injection molding of the coupling plug 1 to the end portion of the cable 6, and to ensure the position and maintenance of position of the plug sleeves 2, 3 on the end portion of the cable 6.

Connection of Plug 1 to Cable 6

The cable 6, contrary to the prior art, can be flat. The solder-free electrical connection between the prongs 9 and the two wires 10 is then easily made by merely pushing the pointed prongs 9 into the elastic cable insulation housing 12, to fit betwen the cable insulation 12 and the wires 10, see arrow C in FIG. 8. The wires 10, as is customary, are formed by a plurality of thin, braided or twisted wires. This permits penetration of the prongs 9 not only between the wires and the insulation, but also between the individual strands of the wires 10, and ensuring excellent electrical connection and contact between the individual strands or wires and the prongs or fingers 9, electrically and mechanically unitary with the sleeves 2, 3.

The elasticity of the insulating jacket 12 of the cable 6 results in some engagement pressure between the prongs 9 and the strand elements of the wires 10. This ensures maintenance of an initial and then continuously good electrical connection. To improve this connection and provide a larger connecting area, the prongs 9 are formed with axially distributed ridges 19, or beads, creases or the like, which additional ensure tight holding of the prongs 9 within the insulating sleeve 12 of the cable 6. As can be seen, the previously necessary removal of insulation cover 12 surrounding the wires 10 is not necessary. The length of the prongs 9, and the penetration thereof, is at least half the length, and preferably the entire length of a clamp 16, to be described.

Figure 6:
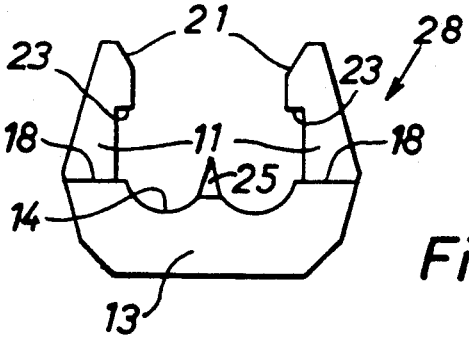
FIG. 6 is an end view of the second clamping portion.
Figure 7:
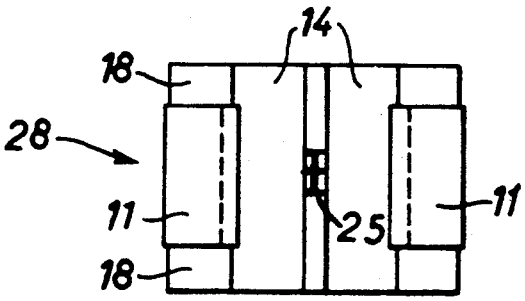
FIG. 7 is a top view of the second clamping portion.

In accordance with a further feature of the invention, the connection is reliably ensured by fitting a clamp 16 (FIG. 1) about the jacket 12 of the cable 6, that is, after the prongs 9, with the sleeves 2, 3, have been inserted therein. The clamp 16 prevents expansion of the cable insulation 12 after introduction of the prongs 9, or compression thereof if they have already slightly expanded, and, additionally, provide for acceptance of forces applied on the connection itself, for example due to excessive axial tension applied to the cable 6, or bending forces closely adjacent the plug 1. The clamp 16—see FIG. 6—is formed with an inwardly extending projection, for example in form of a projecting point or tapered ridge, intended to fit into the web 6' between the wire sleeves 12.

The clamp 16, in accordance with a feature of the invention, is best seen in FIGS. 4–7. The clamp is a two-part element, formed of parts 28 (FIGS. 6, 7) and parts 29 (FIGS. 4, 5), which are locked together by an interengaging projection-and-recess fit. Upon connecting the clamped elements 28, 29, they tightly surround the cable 6, and, specifically, the insulating portions 12 including the web 6' of the cable 6. The part elements 28, 29 are preferably made of plastic, which is a harder plastic than plastic material 12 surrounding the wires 10. A hard plastic is suitable. The clamping element 28, see FIGS. 6, 7, has an essentially U-shaped cross section (FIG. 6) with two projecting legs 11, and a coupling portion 13 connecting the legs 11. The coupling portion 13 is formed with two inner, adjacent, part-cylindrical recesses 14, and an internally projecting point or ridge 25. The point or ridge 25 is provided to penetrate the web 6' between the two cable insulation covers 12. The legs 11 are formed, adjacent their free ends, with inwardly inclined surfaces 21 to facilitate snapping the legs 11 over the part 29, where they can lock with the part 29 by inwardly projecting abutments or shoulders 23.

The clamping part 29 to be fitted on the clamping part 28 is an essentially flat element having its side surfaces recessed with a groove 15. The length of the groove corresponds to the length of the legs 11 of the part 28. Each groove 15 is formed with a shoulder 20. The center portion of the element 29 is formed with two part-cylindrical recesses 17, matching, at least roughly, the outer circumference of the insulation jackets 12 of the cable 6.

Figure 8:
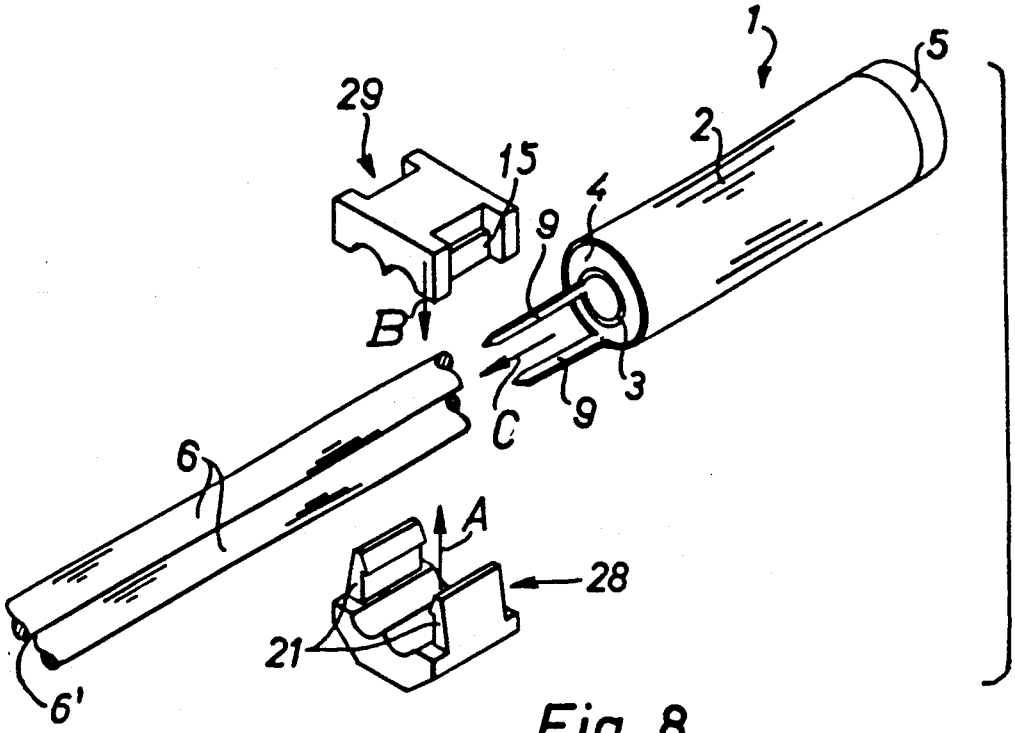
FIG. 8 is an exploded isometric view of the plug and cable before assembly, and before making the connection.

After assembly of the sleeves 2, 3 to the cable 6, by penetrating the prongs into and/or adjacent the wires 10, the parts 28, 29 are moved together as shown by the arrows A, B (FIG. 8). Upon pressing the clamping element 29 against the legs 11, the legs 11 will resiliently spread apart, by engagement with the inclined surface 21, and, upon full seating of the clamping part, the clamping part 28, with the shoulders 23 on the legs 11, will engage behind the set-offs 20 of the part 29, and will, thereby cause the part 29 to fit against the lateral engagement surfaces 18 of the part 28. The rounded recesses 14, 17 will surround the cable 6 and provide radial pressure against the cable insulation covers 12. This ensures reliable seating of the clamp 16 and fixes the clamp 16, in axial direction, on the cable 6. Upon connecting the parts together, the central projection 25 penetrates into the connecting web 6' between the cable covers 12, additionally contributing to axially reliably locating the clamp on the cable 6.

The final formation of the connection involves injection-molding the jacket 7 around the end portion of the cable 6 and part of the sleeve 3—see FIG. 1. The flexible material of the jacket 7 then surrounds the sleeves 2, 3 and the cable 6, providing a tight connection, resistant to damage by tension and/or kinking. Upon injection-molding, the openings 19 and/or openings in the insulation sleeve 4 permit penetration of the injection molding plastic material of the jacket 7.

The invention has been illustrated in connection with a two-wire cable and a two-wire connector. It is equally applicable to cables having more than two wires, for example three, or even more. It is then only necessary to provide three coaxially, mutually insulated sleeve elements, similar to sleeve elements 2, 3. Sleeve element 2 has its prong 9 offset adjacent its inner end portion—see FIG. 3—and for multi-coaxial connectors, multiple offsets of different dimensions can then be used. The respective prongs or fingers 9 can be radially adjacent, or otherwise suitably placed to meet the wires of the multi-strand or wire cable 6.

Various changes and modifications may be made, and any features described herein may be used with any of the others, within the scope of the inventive concept.

For example, it is not necessary that the plug 1 terminate in connecting sleeves. The sleeves 2, 3 could also be formed as flattened elements, so that the plug 1 then will have projecting flat tabs, rather than projecting sleeves 2, 3. In such a construction, the then parallel tabs or connecting flags or prongs will be held in mutually adjacent position, oriented for coupling to a suitable socket, by an insulation element, functionally equivalent to the insulation sleeve 4.

I claim:

1. Solder-free plug-cable connection system, for connecting a plug (1) having at least two electrically conductive plug elements (2, 3) and an electrical plug insulation means (4) separating said plug elements, with a cable (6) having at least two electrically conductive wire means (10) and cable insulation means (12) surrounding and separating said conductive wire means and insulating said wire means with respect to each other, said system comprising, in accordance with the invention, a connection arrangement between said plug (1) and an end portion of said cable (6) while providing a solder-free electrical connection between said conductive plug elements (2, 3) and said connection wire means (10), which arrangement comprises extended, pointed fingers or prongs (9) projecting from said conductive plug elements (2, 3), positioned for penetration between the conductive wire means (10) and the cable insulation means (12) surrounding said wire means, and for engagement, and hence electrical connection with said wire means;

a clamping element (16) tightly surrounding the cable end portion (6) in the region of penetration of said fingers or prongs (9) into the cable; and an injection-molded jacket (7) of insulating, flexible material surrounding the end portion of the cable (6) and at least part of said plug elements.

2. The system of claim 1, wherein said plug elements are sleeve or tubular elements.

3. The system of claim 1, wherein said cable insulation means (12) comprises a flexible resilient elastomer;

and wherein said clamping element (16) is a two-part element comprising insulating material having a hardness and stiffness greater than that of the insulating material of the cable insulating means (12).

4. The system of claim 1, wherein said clamping element comprises two parts (28, 29); and interengaging projection-and-recess means (11, 23; 15, 20) formed on said parts (28, 29) for coupling said parts together to form said clamping means.

5. The system of claim 1, wherein said clamping element comprises a two-part interengaged, snap-connected plastic element.

6. The system of claim 1, wherein said plug elements (2, 3) are tubular or sleeve elements, positioned coaxially within each other;

said plug insulation means comprises an insulating sleeves;

and wherein at least said plug elements are formed with cross bores (27) extending radially therethrough to permit penetration of material of said injection-molded jacket (7) upon injection molding, and securely locating the sleeve plug elements (2, 3) in the plug (1).

7. The system of claim 1, wherein said cable has at least two parallel conductive wire means, and said conductive wire means comprise multi-strand wire elements engaged against each other by at least one of: spiral twisting; braiding, said fingers or prongs (9) penetrating between the individual wire elements.

8. The system of claim 1, wherein the length of said fingers or prongs (9) penetrating between the conductive wire means (10) and the cable insulation means (12) is at least as long as half the axial extent of the clamping element (16).

9. The system of claim 1, wherein said conductive plug elements comprise tubular metal elements, integral with the projecting finger or prong (9).

10. The system of claim 9, wherein said tubular elements are rolled sheet-metal elements.

11. The system of claim 9, wherein said fingers or prongs are pointed.

12. The system of claim 1, wherein said cable insulation means (12) comprises at least two essentially cylindrical wire jackets;

and wherein said clamping element (16) comprises two parts, resiliently coupled together, each part being formed with an essentially cylindrical recess at least partly fitting about the wire jackets, and resiliently pressing the wire jackets within said recesses upon coupling of said two parts.

13. The system of claim 12, wherein said wire jackets forming said cable insulation means (12) are connected by a web or junction (6'); and wherein at least one of said clamping element parts is formed with an internally extending projection (25) engageable against or into said web or junction (6').

* * * * *